US006547615B1

(12) United States Patent
Fletcher

(10) Patent No.: US 6,547,615 B1
(45) Date of Patent: Apr. 15, 2003

(54) FLOTATION DEVICE

(76) Inventor: Adrian Keith Fletcher, 23 Paget Street, Loughborough, Leceistershire LE11 5DS (GB)

( * ) Notice: Subject to any disclaimer, the term of this patent is extended or adjusted under 35 U.S.C. 154(b) by 0 days.

(21) Appl. No.: 10/129,055

(22) PCT Filed: Oct. 24, 2000

(86) PCT No.: PCT/GB00/04099

§ 371 (c)(1),
(2), (4) Date: Apr. 30, 2002

(87) PCT Pub. No.: WO01/32504

PCT Pub. Date: May 10, 2001

(30) Foreign Application Priority Data

Nov. 4, 1999 (GB) ..... 9925995

(51) Int. Cl.[7] ..... B63C 9/28
(52) U.S. Cl. ..... 441/131
(58) Field of Search ..... 441/80, 81–84, 441/131

(56) References Cited

U.S. PATENT DOCUMENTS 4,549,871 A * 10/1985 Verney ..... 441/81
5,458,515 A 10/1995 Busetti

FOREIGN PATENT DOCUMENTS

| | | |
|---|---|---|
| DE | 1 204 550 | 11/1965 |
| EP | 0 867 359 A1 | 9/1998 |
| GB | 401878 | 11/1933 |
| GB | 2 293 806 A | 4/1996 |

* cited by examiner

*Primary Examiner*—Ed Swinehart
(74) *Attorney, Agent, or Firm*—Akerman Senterfitt

(57) ABSTRACT

A flotation device 10 for veering out a lifeline 11 from a moving vessel has parallel keels 13 projecting from opposite sides of its base 14 so that the device will continue to veer laterally of the vessel whichever way up it lies in the water. The point of attachment 12 of the lifeline is on the bisector A of an outwardly-opening angle between keels 13 and 15 on opposite sides of the base 14 and lies at the intersection of lines B and C which are perpendicular to the keels 13 and intersect their planes at points D and E a quarter of the length of the respective keel 13 and 15 from its leading end. In other embodiments there is only one keel on each side of the base, or the base is virtually dispensed with, the point of attachment lying in a corner between upper and lower keels.

10 Claims, 4 Drawing Sheets

FLOTATION DEVICE

BACKGROUND AND FIELD OF THE INVENTION

This invention relates to a flotation device, and more particularly to a flotation device for veering out a lifeline behind a moving vessel such as a boat or ship.

Lifelines are provided on the decks of ships to be thrown overboard in a "man overboard" emergency. Lifebuoys are preferably attached to lifelines so that they are not simply lost when thrown overboard, but lifelines may be attached to flotation devices other than lifebuoys. The purpose of the flotation device, whether a lifebuoy or a smaller buoyant object, is first to give weight to the end of the lifeline enabling it to be thrown from the ship, second to support the trailing end of the line (which will usually be a floating line but which may nevertheless have a tendency to sink when waterlogged), thirdly to make the position of the trailing end of the lifeline visible both from the ship and to the person in the water and in some cases fourthly to provide a buoyant object, such as a lifebuoy, to which the person in the water may cling or even climb into.

The chief difficulty in rescuing a man overboard by means of a streamed lifeline is the danger of running him down in an effort to make the lifeline reach him. A lifeline thrown outwards from a fast moving vessel will immediately adopt a position astern, making it very difficult to bring the line to the person in the water without first running him over. This is particularly dangerous when propellers are running fast, but it may be impracticable to heave to or even slow down appreciably in bad weather conditions not only because of danger to the vessel but because the person in the water might separate and be lost from view.

An object of the present invention is to provide a flotation device which will veer a lifeline away from a moving vessel to one side, making it relatively easy to steer the line across the person in the water without bringing the vessel dangerously close. Provided he is able to grasp the line it does not greatly matter if he cannot immediately reach the flotation device, so that the further the device is veered to one side of the vessel the less accurately the latter has to be manoeuvred. Once the person in the water has got hold of the line he can then move along it either to the flotation device or to the vessel itself.

Flotation devices which will veer a line away from a moving ship are used, for example, in minesweeping and in sea fishing, where they are known as otterboards. However a relatively small, lightweight flotation device such as is stored on deck with a lifeline is vulnerable to being flipped over by the action of wind or waves.

A principal object of the present invention is to provide a flotation device which will continue to veer in the same direction whichever way up it lies in the water. It is thus possible to provide a small, compact, lightweight device which will not present storage and handling problems even when fitted on the deck of a relatively small sailing or motor boat.

In accordance with the present invention there is provided a flotation device for veering out a lifeline behind a moving vessel, comprising at least one first keel member angularly related to at least one second, oppositely projecting keel member, the device being adapted to float with only one of said first and said second keel members normally in the water, the other of said first and second keel members normally upstanding above the water surface, and a point of attachment for the lifeline in an outwardly-opening angle between and in the region of leading ends of said keel members, such that when towed the device will tend to veer in the same direction whichever of said keel members is in the water.

Said point of attachment may be on or near the periphery of a base of the device from opposite sides of which said first and second keel members project, the point of attachment lying on the bisector of an angle of not less than 45° between said keel members.

The base may be generally planar and may be ring-shaped.

Said first and second keel members preferably each have sufficient buoyancy to tend to lift the base to or above the water surface. The base and keels may be formed from buoyant material, and/or either or both may have inflatable areas The device may comprise a plurality of parallel first keel members and a plurality of parallel second keel members angularly related to the first keel members, said point of attachment lying in the outwardly opening angle between outermost of said first and said second keel members.

The point of attachment preferably lies generally at the intersection of lines respectively perpendicular to the, or the nearer, said first and second keel members, said lines intersecting said keel members at points on the latter which are approximately at 25% of the length of the keel member measured from its end nearer to said point of attachment.

Preferred embodiments of the present invention will now be described by way of non-limitative example with reference to the accompanying drawings, in which:

DETAILED DESCRIPTION OF THE DRAWINGS

Figure 1:
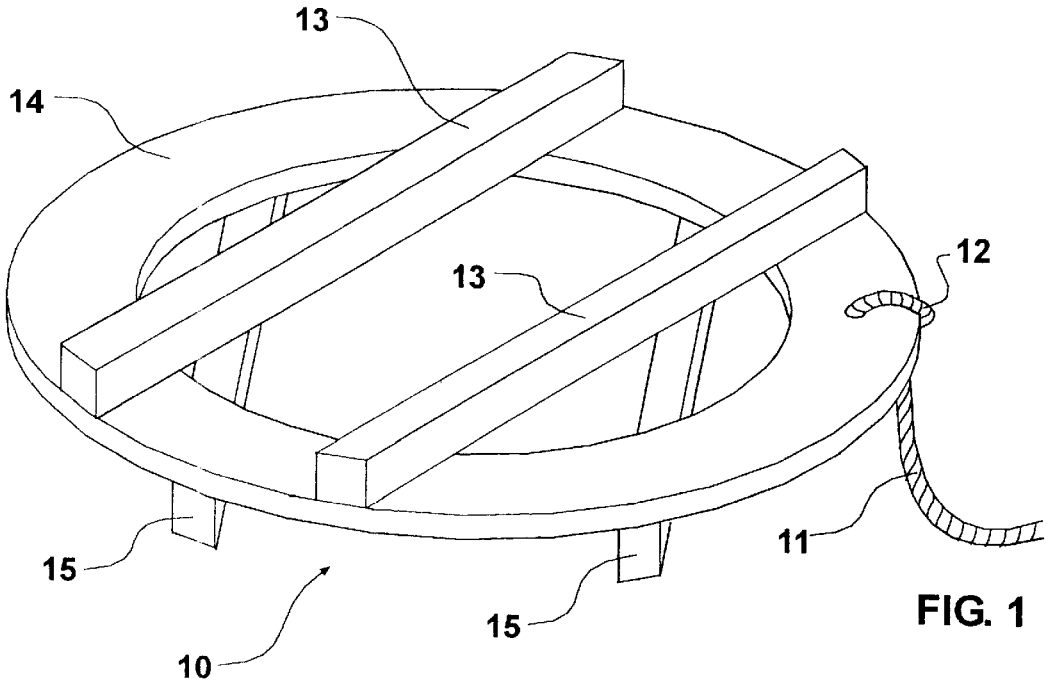
FIG. 1 is a perspective view of a first embodiment of a flotation device in accordance with the invention.
Figure 2:
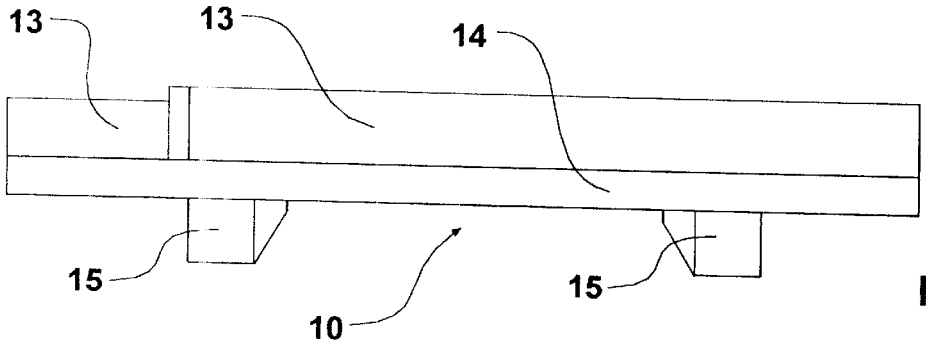
FIG. 2 is a side elevation of the device of FIG. 1.
Figure 3:
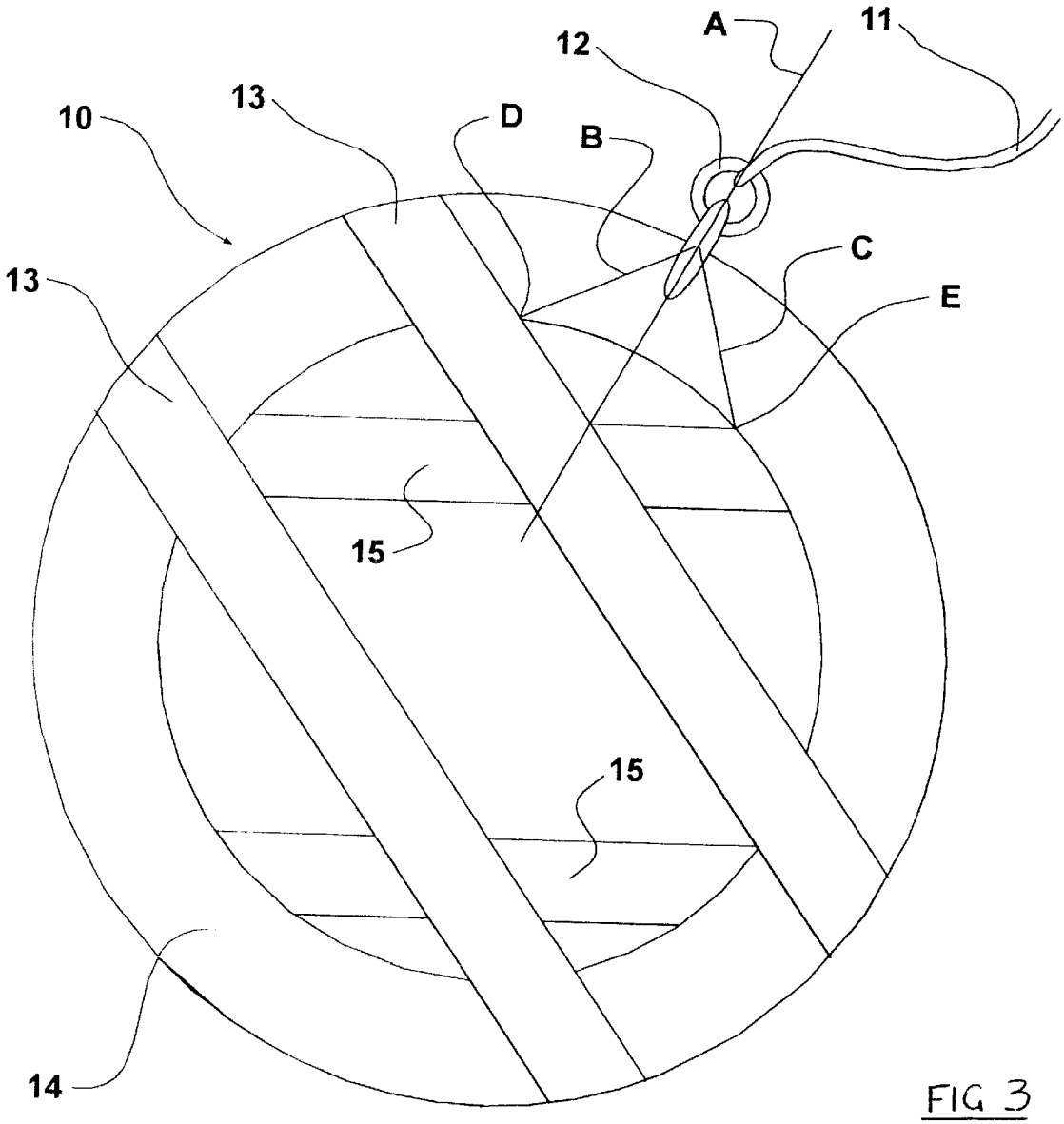
FIG. 3 is a plan view of the device of FIGS. 1 and 2.

The flotation device 10 illustrated in FIGS. 1–3 is for attachment to one end 11 of a lifeline, the other end of the lifeline being secured to a vessel such as a sailing or motor boat. The lifeline is stored coiled up on the deck of the vessel so that it can be thrown into the water in a "man overboard" emergency, when the flotation device 10 first carries the free end of the lifeline clear of the vessel and then, when it enters the water, veers the lifeline to one side of the moving vessel. Alternatively the lifeline could be secured to the vessel near the bow and taken down one side to a predetermined "landing position" nearer the stern.

The point of attachment 12 of the lifeline to the base 14 of the flotation device 10 is so related to keels 13 and 15 of the device that it will veer the lifeline to the starboard side side of the vessel and it is therefore intended to be stored on the starboard side of the deck. Another, oppositely configured, flotation device and attached lifeline should preferably be stored on the port side of the deck.

The base 14 of the device 10 is planar and ring-shaped and two parallel keels 13 and 15 are secured to each of the opposite sides of the base to project therefrom. Each keel 13 and 15 is straight, preferably of substantial thickness and preferably formed from a buoyant material such as a foamed plastics material, so that in use the keels 13 or 15 in the water will tend to raise the base 14 to or above the water surface. In this way the drag of the base 14 through water will not counter the veering action of the keels.

The keels 13 on one side of the base 14 cross those 15 on the other at an obtuse angle of about 120°, and as shown in FIG. 3 the point of attachment 12 of the lifeline lies on the bisector A of one of these obtuse angles opening outwardly of the base 14. The position of the point of attachment 12 is such that it lies at the intersection of lines B and C perpendicular to respective keels 13 and 15 and which intersect the planes of the keels 13 and 15 at points D and E which are at approximately a quarter of the length of the respective keel measured from its leading end, i.e. the end of the keel 13 or 15 nearer to the point of attachment 12.

Both the base 14 and the keels 13 and 15 may be fabricated from a buoyant material such as cork or a foamed plastics material, or may be laminations. To add buoyancy the base 14 and/or the keels 13 and 15 may be formed with inflatable pockets or bladders (not shown).

Figure 4:
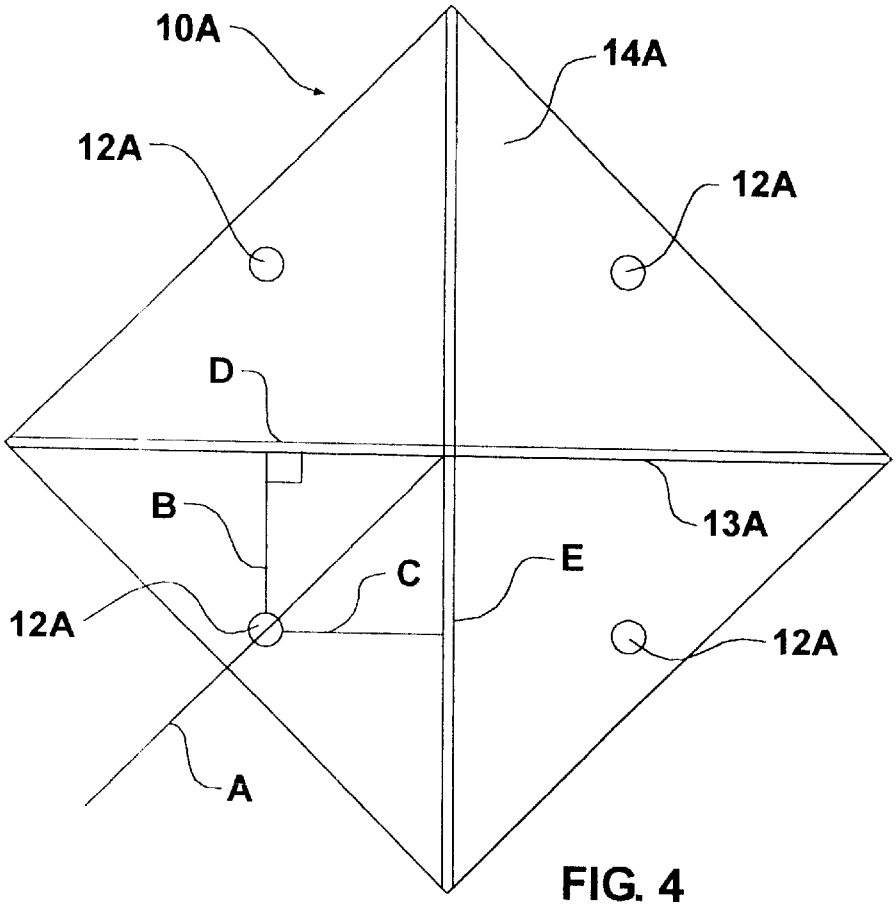
FIG. 4 is a plan view of a second embodiment of a flotation device in accordance with the present invention.
Figure 5:
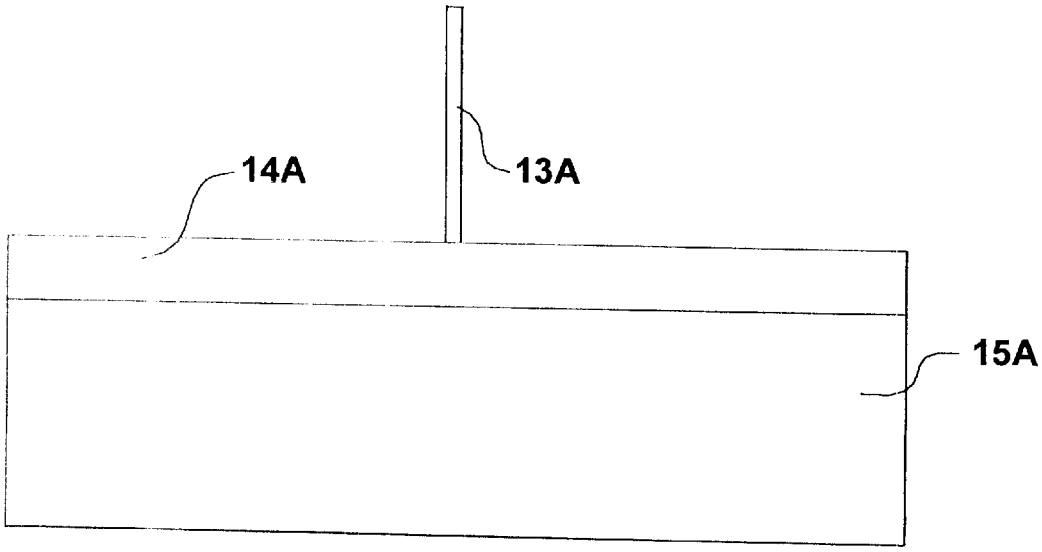
FIG. 5 is a side elevation of the device of FIG. 4.

In the embodiment of FIGS. 4 and 5 the device 10A has only two keels 13A,15A which are at right angles to one another on opposite sides of a square base 14A. The keels 13A and 15A extend to respective, opposed pairs of corners of the base 14A and their is an optionally selectable point of attachment 12A for the lifeline at the mid-point of each side of the base 14A. Consequently each point of attachment 12A lies on the bisector A of one of the right-angles between the keels 13A and 15A and is intersected by lines B and C perpendicular to the keels 13A and 15A which extend from points D and E on the keels substantially distanced from their centres toward what will be their leading ends when being towed.

Figure 6:
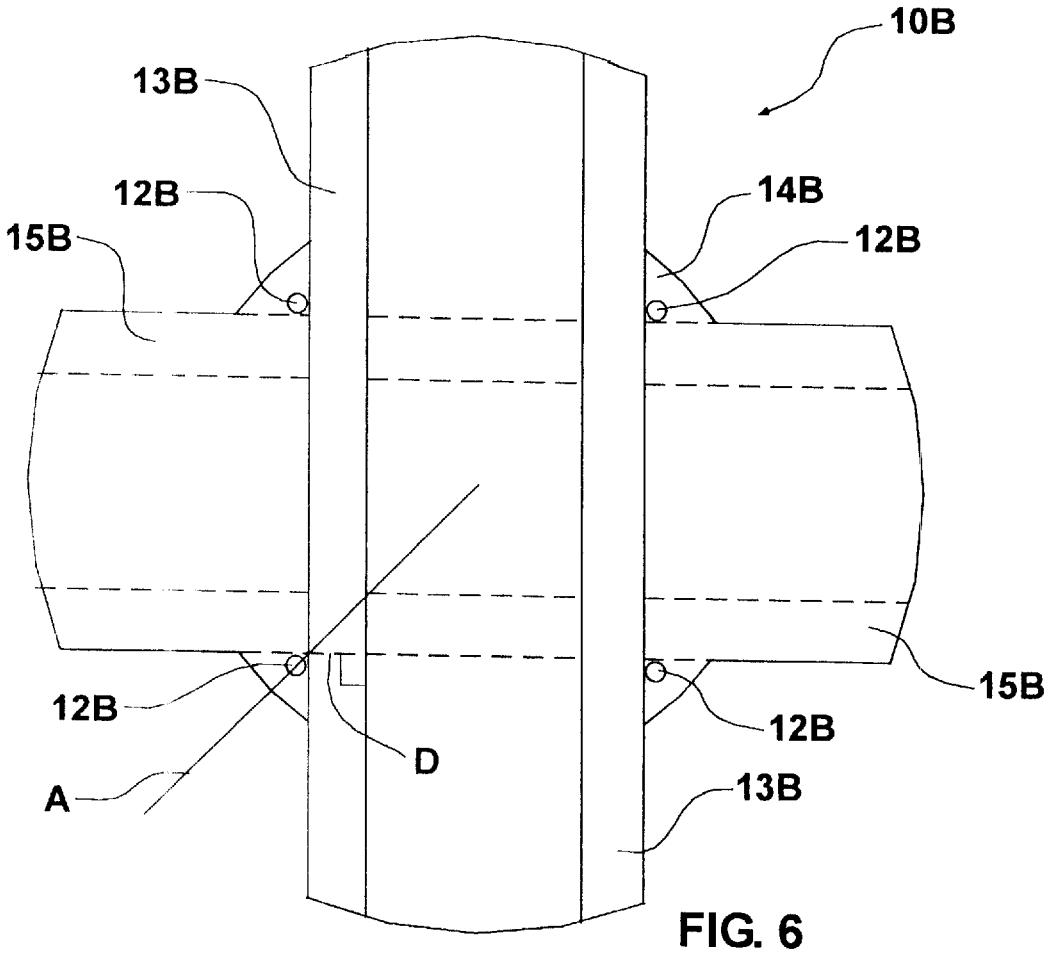
FIG. 6 is a plan view of a third flotation device in accordance with the invention.
Figure 7:
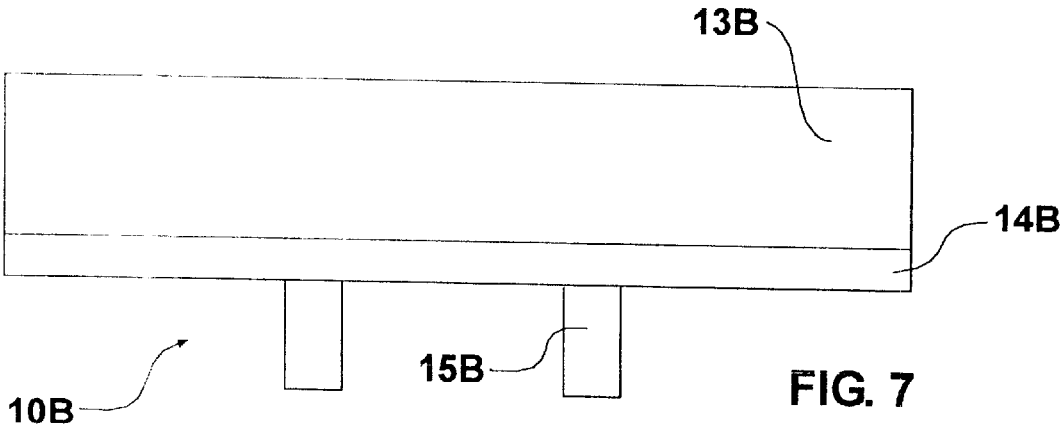
FIG. 7 is a side elevation of the device of FIG. 6.

In the embodiment of FIGS. 6 and 7, in common with that of FIGS. 1–3, there are two parallel keels 13B and 15B on each side of the base 14B and there are four optionally selectable points of attachment 12B in the outer corners between outermost keels 13B and 15B.

If used the base 14 need not be planar, although it is preferably a thin, open structure offering a minimum of drag when immersed. More than two parallel keels may be provided on each side of the device and depending on their thickness and disposition the base 14 may be dispensed with, the point of attachment 12 being simply at a corner between two outermost, angularly related keels 13 and 15. Depending on the dimensions and weight of the device 10 it may be desirable to alter the angle of attack of an end or side of a keel 13 or 15 either to tend to raise the base 14 out of the water or draw it downward into the water.

The periphery of the base 14, if present, may be provided with loops of line (not shown) to serve as handles to be grabbed by a person in the water. If sufficiently large the device 10 may serve as a lifebuoy, the person in the water placing the base 14 around the chest with the upper keels 13 under the armpits.

When the device of the invention is thrown overboard from a moving vessel it will veer the lifeline to which it is attached laterally of the vessel. Thus when the vessel is turned to go back to the person in the water it steers to the appropriate side of him, keeping a safe distance, until the lifeline is drawn across him. He can then grab either the line or the flotation device. With the vessel now slowed down or stationary the person to be rescued can then pull the line in hand over hand until he reaches either the vessel itself or the flotation device.

What is claimed is:

1. A flotation device for veering out a lifeline comprising:

at least one first keel member angularly related to at least one second, oppositely projecting keel member;

the device being adapted to float with only one of said first and second keel members in the water;

the other of said first and second keel members upstanding above the water surface; and a point of attachment for the lifeline in an outwardly-opening angle between and in the region of leading ends of said keel members, such that when in relatively moving water the device will tend to veer in the same direction whichever of said keel members is in the water.

2. A flotation device as claimed in claim 1, wherein said point of attachment is on or near the periphery of a base of the device from opposite sides of which said first and second keel members project, the point of attachment lying on the bisector of an angle of not less than 45° between said keel members.

3. A flotation device as claimed in claim 2, wherein the base is generally planar.

4. A flotation device as claimed in claim 3, wherein the base is ring-shaped.

5. A flotation device as claimed in claim 3, wherein said first and second keel members each have sufficient buoyancy to tend to lift the base to or above the water surface.

6. A flotation device as claimed in claim 2, wherein the base and keels are formed from buoyant material.

7. A flotation device as claimed in claim 2, wherein the base has inflatable areas.

8. A flotation device as claimed in claim 1, comprising a plurality of parallel first keel members and a plurality of parallel second keel members angularly related to the first keel members, said point of attachment lying in the outwardly opening angle between outermost of said first and second keel members.

9. A flotation device as claimed in claim 1, wherein the point of attachment lies generally at the intersection of lines respectively perpendicular to said first and second keel members, said lines intersecting said keel members at points on the latter which are approximately at 25% of the length of the keel member measured from its end nearer to said point of attachment.

10. A flotation device as claimed in claim 2, wherein at least one of the keels has inflatable areas.

* * * * *